US009463627B2

(12) United States Patent
Somete

(10) Patent No.: US 9,463,627 B2
(45) Date of Patent: Oct. 11, 2016

(54) RECOVERY SYSTEM FOR RECORDING HEAD AND INK-JET RECORDING APPARATUS INCLUDING THE SAME

(71) Applicant: KYOCERA Document Solutions Inc., Osaka (JP)

(72) Inventor: Takashi Somete, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/942,238

(22) Filed: Nov. 16, 2015

(65) Prior Publication Data

US 2016/0152031 A1 Jun. 2, 2016

(30) Foreign Application Priority Data

Nov. 28, 2014 (JP) ..... 2014-241160

(51) Int. Cl.
*B41J 2/165* (2006.01)

(52) U.S. Cl.
CPC ..... *B41J 2/16508* (2013.01); *B41J 2/16538* (2013.01); *B41J 2/16547* (2013.01); *B41J 2/16585* (2013.01); *B41J 2002/16591* (2013.01)

(58) Field of Classification Search
CPC B41J 2/16517; B41J 2/1652; B41J 2/16505; B41J 2/16535; B41J 2/16538; B41J 2/16547; B41J 2/1707; B41J 2/1714; B41J 2002/1655
USPC ..... 347/33–35
See application file for complete search history.

(56) References Cited

U.S. PATENT DOCUMENTS 6,109,725 A * 8/2000 Saikawa ..... B41J 2/16538 347/33
6,669,328 B2 * 12/2003 Lin ..... B41J 2/16538 347/33
8,544,985 B2 * 10/2013 Heo ..... B41J 2/16547 347/22
2006/0262159 A1 * 11/2006 Sakurai ..... B41J 2/16538 347/33
2008/0007592 A1 * 1/2008 Watanabe ..... B41J 2/16538 347/33
2010/0259580 A1 * 10/2010 Tsuji ..... B41J 2/16547 347/33
2013/0106952 A1 * 5/2013 Tsuji ..... B41J 2/16538 347/33

FOREIGN PATENT DOCUMENTS

JP 2013-49205 A 3/2013
JP 2013049205 A * 3/2013

* cited by examiner

*Primary Examiner* — Alessandro Amari
*Assistant Examiner* — Sharon A Polk
(74) *Attorney, Agent, or Firm* — Stein IP, LLC

(57) ABSTRACT

A recovery system for a recording head according to the present disclosure includes a wiper, a drive mechanism, and a control portion. The control portion is able to execute a recovery operation for the recording head that includes an ink pushing-out operation that forcibly pushes out ink, a first wiping operation that moves the wiper in a first direction to wipe away purged ink, and a second wiping operation that moves the wiper in a direction opposite to the first direction to wipe away remaining ink. The wiper includes a first wiping surface disposed to face in the first direction, a second wiping surface disposed to face in a direction opposite to the first direction, and an upper surface. The first wiping surface and the upper surface have a high water repellency compared with the second wiping surface.

20 Claims, 17 Drawing Sheets

RECOVERY SYSTEM FOR RECORDING HEAD AND INK-JET RECORDING APPARATUS INCLUDING THE SAME

INCORPORATION BY REFERENCE

The present application is based on Japanese Patent Application No. 2014-241160 filed on Nov. 28, 2014, the contents of which are hereby incorporated by reference.

BACKGROUND

The present disclosure relates to an ink-jet recording apparatus that performs recording by ejecting ink onto a recording medium such as a paper sheet, more particularly, to a recording head recovery system that performs a purge operation to forcibly push out ink from an ejecting nozzle of a recording head, thereafter, wipes away the purged ink adhering to an ink ejecting surface by means of a wiper.

As recording apparatuses such as a facsimile, a copy machine, a printer, ink-jet recording apparatuses which form an image by ejecting ink are widely used because they can form a high-definition image.

In such ink-jet recording apparatuses, there is a case where deterioration (curved fly) in linear traveling of ink, failed ink ejection and the like occur and printing performance of the recording head declines. As a cause of this, occurrence of a meniscus trouble is conceivable which is caused by that foreign mater such as paper powder, dust and debris occurring during a sheet (recording medium) conveyance time, a minuscule ink drop (hereinafter, called a mist) ejected along with an ink drop for image recording, and a bouncing mist, which occurs when the ink drop adheres to the recording medium, adheres to the ink ejecting surface of the recording head. Besides, decline in sealing performance during a cap mounting time caused by that the mist adheres to a cap mounting place and dries and occurrence of increased viscosity of the ink in the nozzle due to the sealing performance decline are also conceivable as causes of this.

Because of this, a structure is used, in which to prevent: the drying of ink in the ink ejecting nozzle whose opening is formed through the ink ejecting surface of the recording head; and clogging of the nozzle caused by the thickened ink in the ink ejecting nozzle, the ink is forcibly pushed out (purged) from the nozzle, thereafter, the purged ink adhering to the ink ejecting surface (nozzle surface) is wiped away by means of a blade-like wiper to perform a recording head recovery process.

For example, a method is known, in which the wiper is pressed at a predetermined contact pressure against a part of the ink ejecting surface of the recording head, where there is not a nozzle, to clean the ink ejecting surface. Specifically, as shown in FIG. 28A, a wiper 103 is pressed substantially perpendicularly to a region (wiping start position) outside a nozzle region 102, where ink ejecting nozzles are disposed, of an ink ejecting surface 101*a* of a recording head 101. Next, as shown in FIG. 28B, FIG. 28C, the wiper 103 is horizontally moved along the ink ejecting surface 101*a* in an arrow A direction to wipe away ink 104 on the nozzle region 102, and as shown in FIG. 28D, after the wiper 103 is made to leave the ink ejecting surface 101*a*, the wiper 103 is horizontally moved in an arrow A' direction and returned to the wiping start position.

But, according to the method shown in FIG. 28A to FIG. 28D, as shown in FIG. 29A, inks 104*a*, 104*b* respectively adhere to a side surface and tip end of the wiper 103 during the second wiping time. The inks 104*a*, 104*b* adhering to the side surface and tip end of the wiper 103 are exposed to air to thicken, and accordingly, adhere to the ink ejecting surface 101*a* as shown in FIG. 29B and FIG. 29C.

Besides, a wiping mechanism for an ink-jet recording apparatus is known, which has two wipers that can successively contact the ink ejecting surface of the recording head wherein the preceding wiper wipes away the purged ink and the following wiper wipes away ink that remains near a wiping start position of the preceding wiper.

SUMMARY

A recovery system for a recording head according to an aspect of the present, disclosure is a recovery system for a recording head that is provided with a nozzle region from which an ejecting nozzle for ejecting ink onto a recording medium is opened, and which includes a wiper, a drive mechanism, and a control portion. The wiper wipes away purged ink that is forcibly pushed out from the ejecting nozzle. The drive mechanism reciprocates the wiper along an ink ejecting surface that includes the nozzle region. The control portion controls the pushing-out and ejection of the ink from the ejecting nozzle and the operation of the drive mechanism. The control portion can execute a recording head recovery operation that includes: an ink pushing-out operation that forcibly pushes out the ink from the ejecting nozzle and makes the purged ink adhere to the nozzle region; a first wiping operation that presses the wiper against a first position outside the nozzle region of the ink ejecting surface, thereafter, moves the wiper to the nozzle region in a first direction along the ink ejecting surface with the wiper pressed against the ink ejecting surface, thereby makes ink remaining on a tip end of the wiper adhere to the first position, wipes away the purged ink, and moves the wiper to a second position opposite to the first position with respect to the nozzle region; a leaving operation that after execution of the first wiping operation, makes the wiper leave the ink ejecting surface; and a second wiping operation that after execution of the leaving operation, presses the wiper against the ink ejecting surface, moves the wiper in a second direction opposite to the first direction along the ink ejecting surface with the wiper pressed against the ink ejecting surface and thereby wipes away the remaining ink. The wiper includes: a first wiping surface disposed to face in the first direction; a second wiping surface disposed to face in the second direction; and an upper surface disposed between the first wiping surface and the second wiping surface, wherein the first wiping surface and the upper surface have a high water repellency compared with the second wiping surface.

Still other objects of the present disclosure and specific advantages obtained by the present disclosure will become more apparent from the following description of an embodiment.

DETAILED DESCRIPTION

Hereinafter, an embodiment of the present disclosure is described with reference to the drawings.

Figure 1:
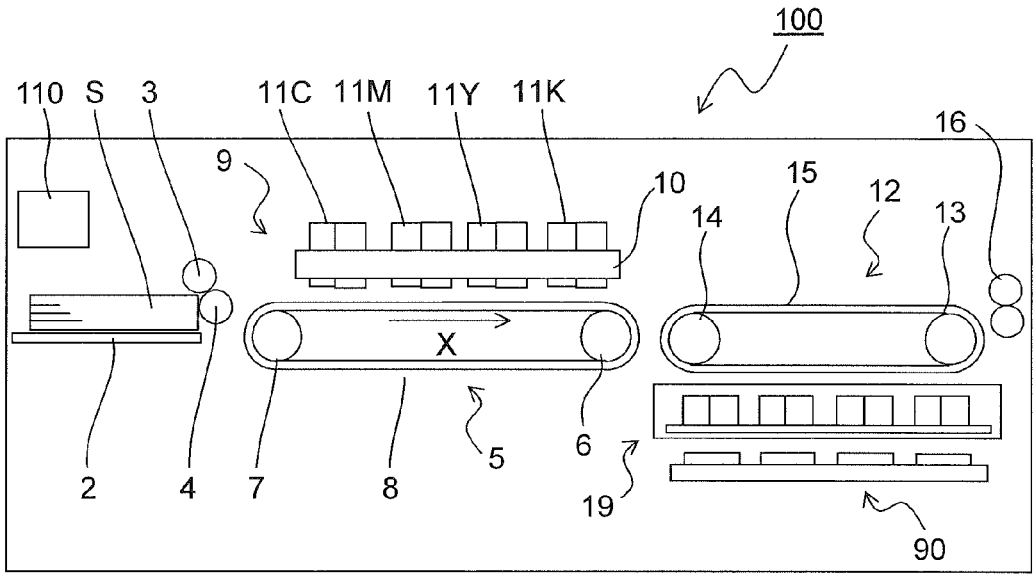
FIG. 1 is a view showing a structure of an ink-jet recording apparatus according to an embodiment of the present disclosure.

As shown in FIG. 1, a sheet feeding tray 2 storing paper sheets S (recording media) is disposed in a left portion of an ink-jet recording apparatus 100 according to the embodiment of the present disclosure. One end of the sheet feeding tray 2 is provided with a sheet feeding roller 3, which conveys and feeds the sheets S stored in the sheet feeding tray 2 one after another beginning with the uppermost sheet S to a first conveyance unit 5 described later, and a driven roller 4 that is pressed against the sheet feeding roller 3 and driven to rotate.

The first conveyance unit 5 and a recording portion 9 are disposed downstream (right of FIG. 1) from the sheet feeding roller 3 and driven roller 4 with respect to a sheet conveyance direction (arrow X direction). The first conveyance unit 5 includes a first drive roller 6, a first driven roller 7, and a first conveyance belt 8 mounted on the first drive roller 6 and first driven roller 7, wherein the first drive roller 6 is driven to rotate in a clockwise direction based on a control signal from a control portion 110 of the ink-jet recording apparatus 100, whereby the sheet S held by the first conveyance belt 8 is conveyed in the arrow X direction.

Figure 2:
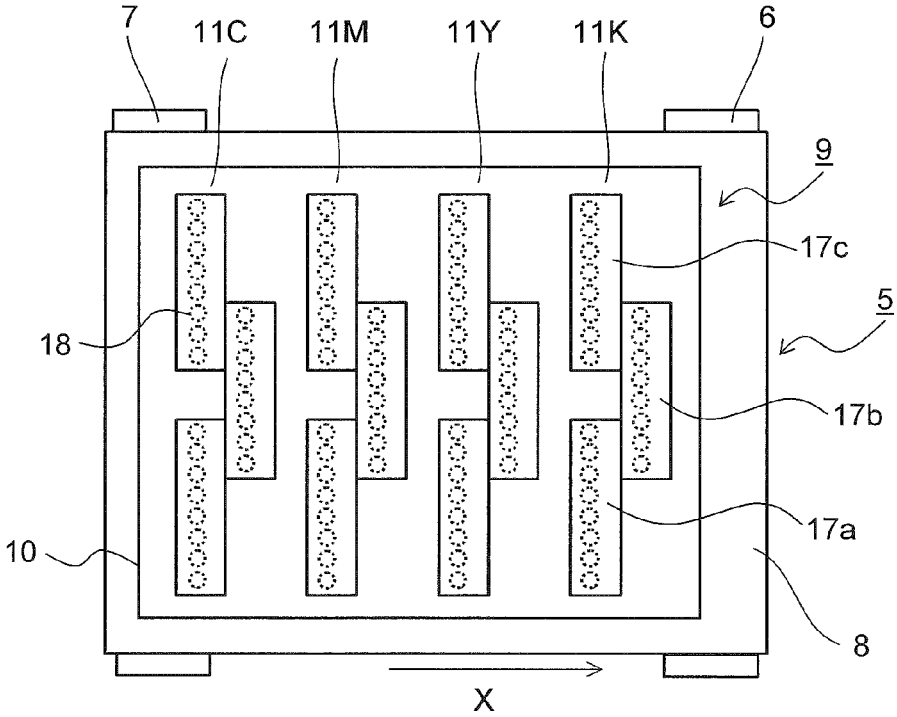
FIG. 2 is a view of a first conveyance unit and a recording portion of the ink-jet recording apparatus shown in FIG. 1 seen from above.
Figure 3:
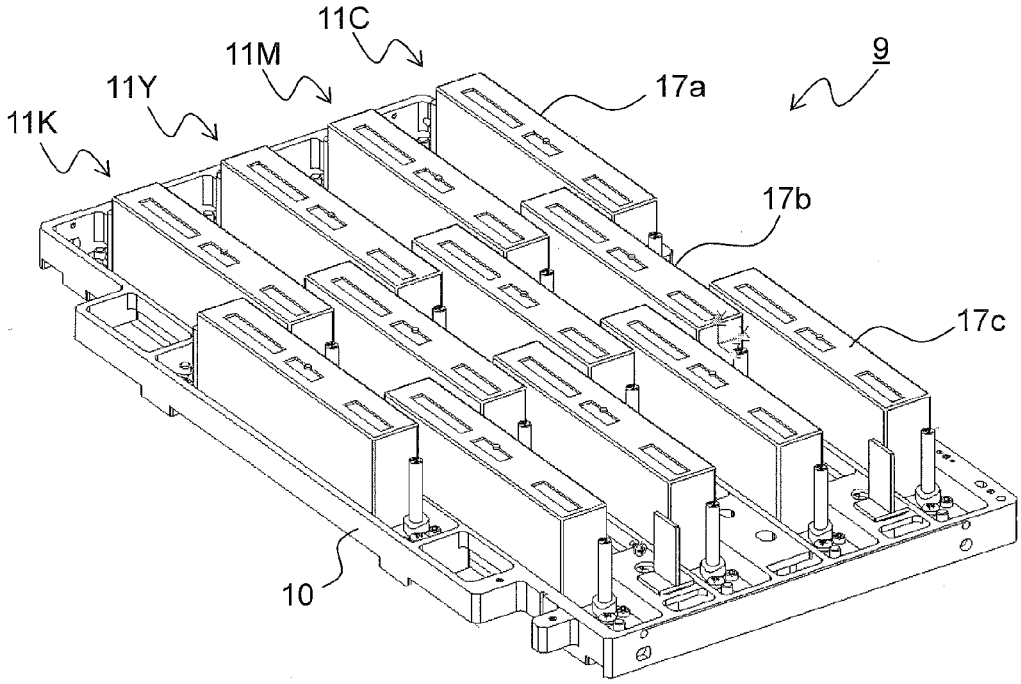
FIG. 3 is a view of a recording portion seen from diagonally above.

The recording portion 9 includes a head housing 10, line heads 11C, 11M, 11Y, and 11K which are held by the head housing 10. These line heads 11C to 11K are supported at a height to form a predetermined distance (e.g., 1 mm) from a conveyance surface of the first conveyance belt 8, and as shown in FIG. 2 and FIG. 3, a plurality of recording heads 17*a* to 17*c* (here, three) are arranged in a staggering pattern along a sheet width direction (vertical direction of FIG. 2) perpendicular to the sheet conveyance direction. In the meantime, FIG. 3 shows a state of the recording portion 9 seen from behind FIG. 1 (above FIG. 2), and the arrangement of the line heads 11C to 11K is reverse in FIG. 1 and FIG. 2.

Figure 4:
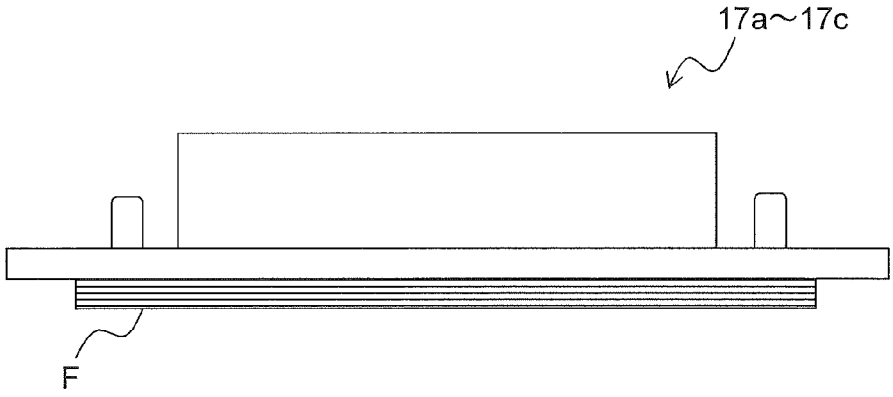
FIG. 4 is a view of a recording head that composes a line head of the recording portion.
Figure 5:
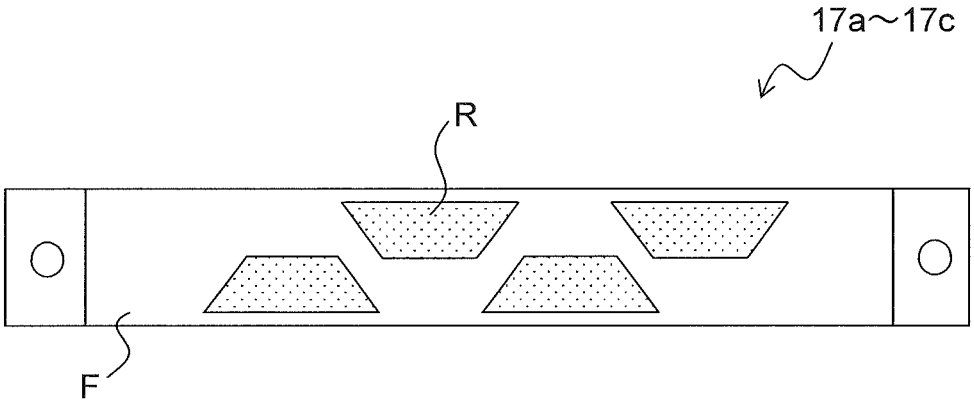
FIG. 5 is a view of the recording head seen from an ink ejecting surface side.

As shown in FIG. 4 and FIG. 5, ink ejecting surfaces F of the recording heads 17*a* to 17*c* are each provided with nozzle regions R where many ink ejecting nozzles (ejecting nozzles) 18 are arranged. In the meantime, the recording heads 17*a* to 17*c* have the same shape and structure. Accordingly, in FIG. 4 and FIG. 5, one drawing represents the recording heads 17*a* to 17*c*.

The recording heads 17*a* to 17*c* composing each line head 11C to 11K are supplied with four color inks (cyan, magenta, yellow, and black) stored in respective ink tanks (not shown) corresponding to the respective line heads 11C to 11K.

By means of control signals from the control portion 110 (see FIG. 1), each recording head 17*a* to 17*c* ejects ink, in accordance with image data received from an external computer, from the ink ejecting nozzles 18 to the sheet S that is attracted and held on the conveyance surface of the first conveyance belt 18. In this way, the four color inks of cyan, magenta, yellow and black are superimposed, whereby a color image is formed on the sheet S on the sheet conveyance belt 8.

Besides, to prevent defective ink ejection caused by drying or clogging of the recording heads 17*a* to 17*c*, when starting a print operation after a long period suspension, a purge is executed to push out thickened ink from the ink ejecting nozzles 18 of all the recording heads 17*a* to 17*c*, and between the print operations, a purge is executed to push out thickened ink from the ink ejecting nozzles 18 of some of the recording heads 17*a* to 17*c* whose ink ejecting amount is less than a predetermined value, thereby preparing for the next printing operation.

Besides, a hydrophilic member 60 (see FIG. 17) having a high hydrophilicity compared with the nozzle region R is attached to one end portion of an ink ejecting surface F of the recording heads 17*a* to 17*c*. The hydrophilic member 60 is formed of a SUS plate having a thickness of, for example, 50 to 100 μm, and a contact angle (about 90° or smaller) of the hydrophilic member 60 to water is about 20° smaller than a contact angle (about 110°) of the nozzle region R. Besides, a part of the hydrophilic member 60 protrudes outward from the ink ejecting surface F, and the protruding part is bent upward to form an inclined surface 60*a*. In the meantime, the inclined surface 60*a* is bent, for example, about 60° to the ink ejecting surface F.

Back to FIG. 1, a second conveyance unit 12 is disposed downstream (right of FIG. 1) from the first conveyance unit 5 in the sheet conveyance direction. The second conveyance unit 12 includes a second drive roller 13, a second driven roller 14, and a second conveyance belt 15 mounted on the second drive roller 13 and second driven roller 14, wherein the second drive roller 13 is driven to rotate in a clockwise direction, whereby the sheet S held by the second conveyance belt 15 is conveyed in the arrow X direction.

The sheet S on which an ink image is formed by the recording portion 9 is conveyed to the second conveyance unit 12, and during passing through the second conveyance unit 12, the ink ejected to the sheet S surface is dried. Besides, a maintenance unit 19 and a cap unit 90 are disposed under the second conveyance unit 12. When performing the above purge, the maintenance unit 19 moves under the recording portion 9, wipes away the ink pushed out from the ink ejecting nozzles 18 of the recording heads 17*a* to 17*c*, and collects the wiped ink. When capping the ink ejecting surface F (see FIG. 4) of the recording heads 17*a* to 17*c*, the cap unit 90 horizontally moves under the recording portion 9, further, moves upward to be mounted on a lower surface of the recording heads 17*a* to 17*c*. In the meantime, a detailed structure of the maintenance unit 19 is described later.

Besides, a delivery roller pair 16, which delivers the sheet S on which an image is recorded to outside an apparatus main body, is disposed downstream from the second conveyance unit 12 with respect to the sheet conveyance direction, and a delivery tray (not shown), in which the sheet S delivered to outside the apparatus main body is loaded, is disposed downstream from the delivery roller pair 16.

Figure 6:
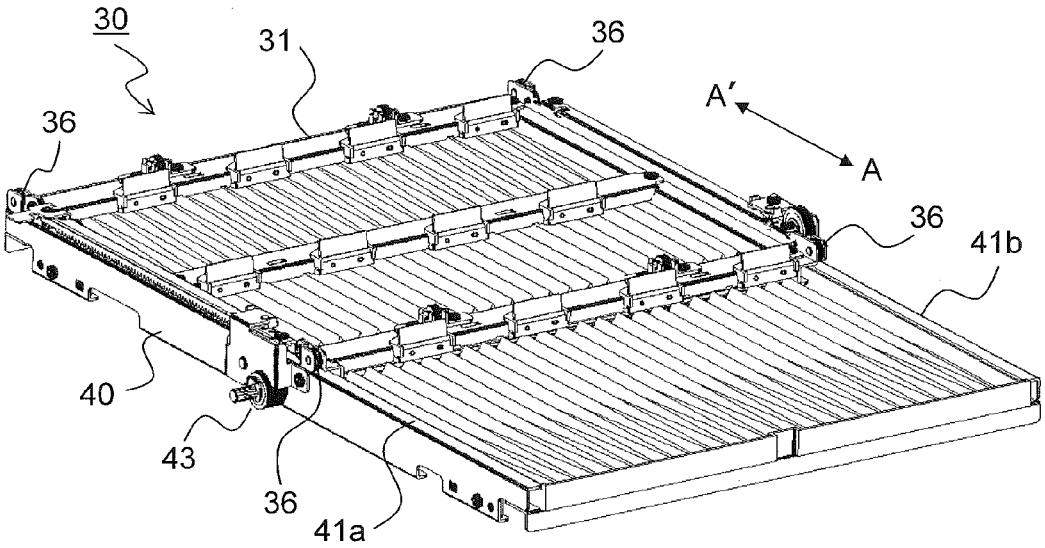
FIG. 6 is a view of a wiping mechanism incorporated in a maintenance unit seen from diagonally above.

The maintenance unit 19 is mounted with a wiping mechanism 30 shown in FIG. 6. The wiping mechanism 30 is composed of a substantially rectangular carriage 31 to which a plurality of wipers 35*a* to 35*c* are fixed, and a support frame 40 that supports the carriage 30. Rail portions 41*a*, 41*b* are formed on opposing end edges of an upper surface of the support frame 40, and slide rollers 36 disposed at four corners of the carriage 31 abut the rail portions 41*a*, 41*b*, whereby the carriage 31 is supported slidably in an arrow AA' direction with respect to the support frame 40.

Figure 7:
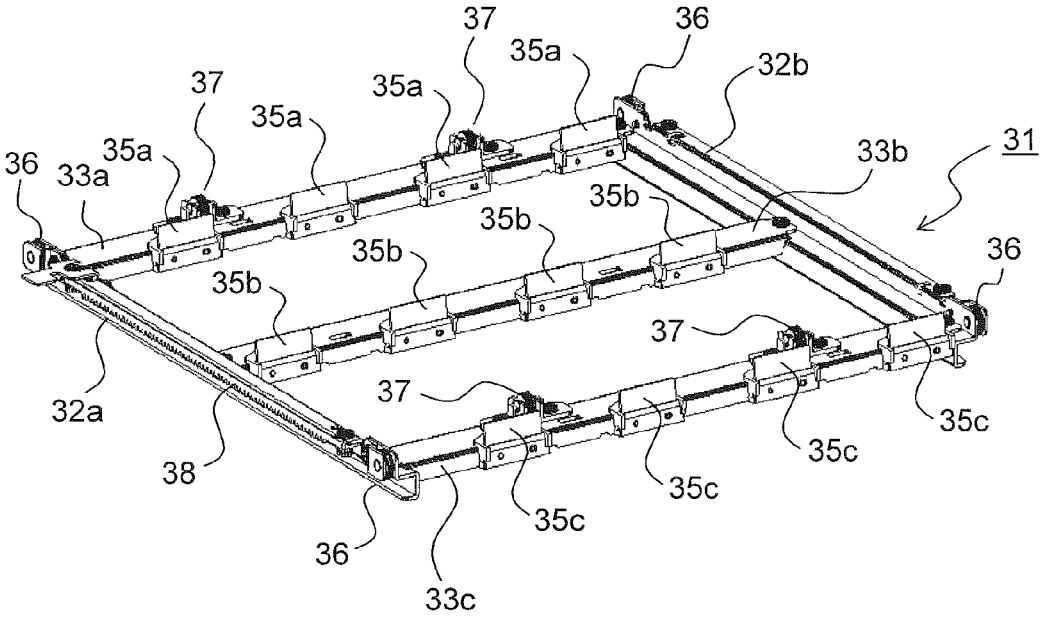
FIG. 7 is a view of a carriage composing the wiping mechanism seen from diagonally above.

As shown in FIG. 7, the carriage 31 is formed into a frame shape by first stays 32*a*, 32*b* that slidably engage with the rail portions 41*a*, 41*b* of the support frame 40 via the slide rollers 36, and second stays 33*a*, 33*b*, and 33*c* that are fixed between the first stays 32*a*, 32*b* like bridges.

The first stay 32*a* is provided with rack teeth 38 that mesh with an input gear 43 (see FIG. 6) held by the support frame 40. When the input gear 43 rotates in forward and backward directions, the carriage 31 reciprocates in a horizontal direction (arrow AA' direction of FIG. 6) along the support frame 40. In the meantime, a drive mechanism of the present disclosure is composed of the rack teeth 38 and the input gear 43.

The wipers 35*a* to 35*c* are members that wipe away the ink pushed out from the ink ejecting nozzles 18 of the respective recording heads 17*a* to 17*c*. The wipers 35*a* to 35*c* are pressed from substantially vertical directions against positions outside the nozzle region R (see FIG. 5) from which nozzle surfaces of the ink ejecting nozzles 18 are exposed, and clean the ink ejecting surface F including the nozzle region R in a predetermined direction (arrow AA' direction of FIG. 6) in accordance with the movement of the carriage 31.

Four wipers 35*a* are fixed to the second stay 33*a* at substantially equal intervals, likewise, four wipers 35*b* are fixed to the second stay 33*b* at substantially equal intervals, and four wipers 35*c* are fixed to the second stay 33*c* at substantially equal intervals. The wipers 35*a*, 35*c* are respectively disposed at positions corresponding to the left and right recording heads 17*a*, 17*c* (see FIG. 3) that compose each line head 11C to 11K. Besides, the wiper 35*b* is disposed at a position corresponding to the central recording head 17*b* (see FIG. 3) that composes each line head 11C to 11K, is deviated and fixed a predetermined distance away from the wipers 35*a*, 35*c* in a direction perpendicular to the movement direction (arrow AA' direction of FIG. 6) of the carriage 31.

Figure 8:
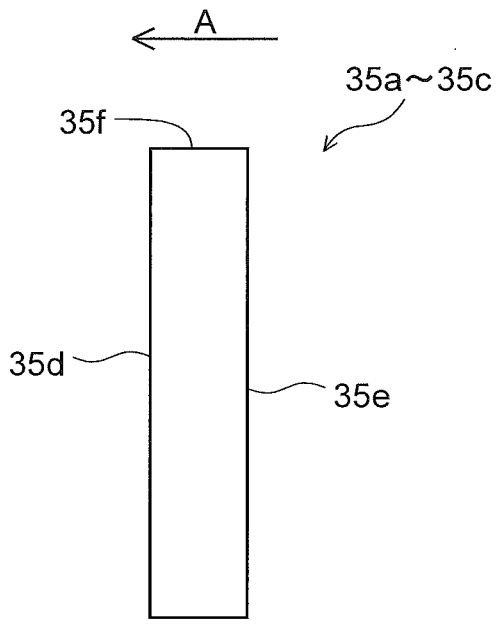
FIG. 8 is a view showing a structure of a wiper from a wiper width direction.
Figure 9:
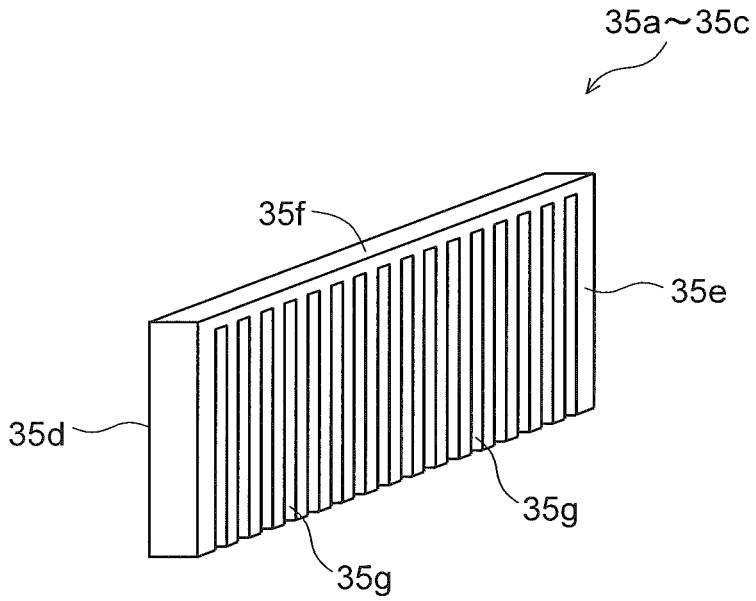
FIG. 9 is a view showing a structure of a second wiping surface of a wiper.

As shown in FIG. 8 and FIG. 9, each wiper 35*a* to 35*c* includes: a first wiping surface 35*d* that is disposed to face in the A direction (first direction) and wipes away purged ink 22*b* (see FIG. 17) during a first wiping operation time described later; a second wiping surface 35*e* that is disposed to face in a direction opposite to the A direction and wipes away the purged ink 22*b* and remaining ink 22*a* during a second wiping operation time described later; and an upper surface 35*f* that is disposed between the first wiping surface 35*d* and the second wiping surface 35*e*.

A water-repellent treatment (water-repellent coating) is applied to the first wiping surface 35*d* and the upper surface 35*f*, thereby the first wiping surface 35*d* and the upper surface 35*f* have a high water repellency compared with the second wiping surface 35*e*. Besides, also the first wiping surface 35*d* and the upper surface 35*f* have a high water repellency compared with the nozzle region R and a second position P2 (hydrophilic member 60) described later.

On the other hand, a hydrophilic treatment (hydrophilic processing) is applied to the second wiping surface 35*e*, thereby the second wiping surface 35*e* has a high hydrophilic nature compared with the first wiping surface 35*d* and the upper surface 35*f*. Specifically, the second wiping surface 35*e* is provided with a plurality of grooves 35*g* that extend in a vertical direction. The groove 35*g* has a width of about 1 mm (wiper width direction (direction crossing the arrow A direction, direction perpendicular to the paper surface of FIG. 8)), a depth of about 0.5 mm (length in the arrow A direction), and formed about 1 mm away from the upper surface 35*f* at a pitch of about 2 mm in the wiper width direction.

As a water repellent treatment method and hydrophilic treatment method for the wipers 35*a* to 35*c*, first, rectangular-parallelepiped wipers 35*a* to 35*c* are prepared. And, the first wiping surface 35*d* is disposed to face downward and dipped into water repellent material, thereafter, left for about 1 hour at about 60° C., about 80% RH (relative humidity), whereby a water repellent film (not shown) is formed on the first wiping surface 35*d*. Next, the upper surface 35*f* is disposed to face downward and dipped into the water repellent material, thereafter, left for about 1 hour at about 60° C., about 80% RH (relative humidity), whereby a water repellent film (not shown) is formed on the upper surface 35*f*. Thereafter, by cutting a predetermined portion of the second wiping surface 35*e*, the plurality of grooves 35*g* are formed. As described above, the water repellent treatment and hydrophilic treatment for the wipers 35*a* to 35*c* are performed.

In the meantime, as the water repellent material, it is possible to use the OPTOOL DSX-E from DAIKIN INDUSTRIES, Ltd., the NB05-02 from T & K TOKA, the Fluoro Surf FG-5091SH-0.5, FG-5080SH-0.1 from Fluoro Technology, the KP-911 from Shin-Etsu Chemical Co., Ltd., the Novec2702, Novce1720 from 3M Japan Limited, the SFE-DP02H, SCV-B002C, SFE-X14H from AGC SEIMI CHEMICAL CO., LTD., the RBX-HC1, RBX-9100 from Neos Corporation, the MAK COAT F02 from KITAZAWA YAKUHIN CORPORATION and the like.

As shown in FIG. 7, gap rollers 37 are dispose at four positions of upper surfaces of the second stays 33*a*, 33*c*. When the wiping mechanism 30 is stepped up toward the recording portion 9 to perform the wiping operation by the wipers 35*a* to 35*c* for the ink ejecting surface F of the recording heads 17*a* to 17*c*, the gap rollers 37 come into contact with the head housing 10 of the recording portion 9 to keep a contact state of the wipers 35*a* to 35*c* with the ink ejecting surface F constant.

Figure 10:
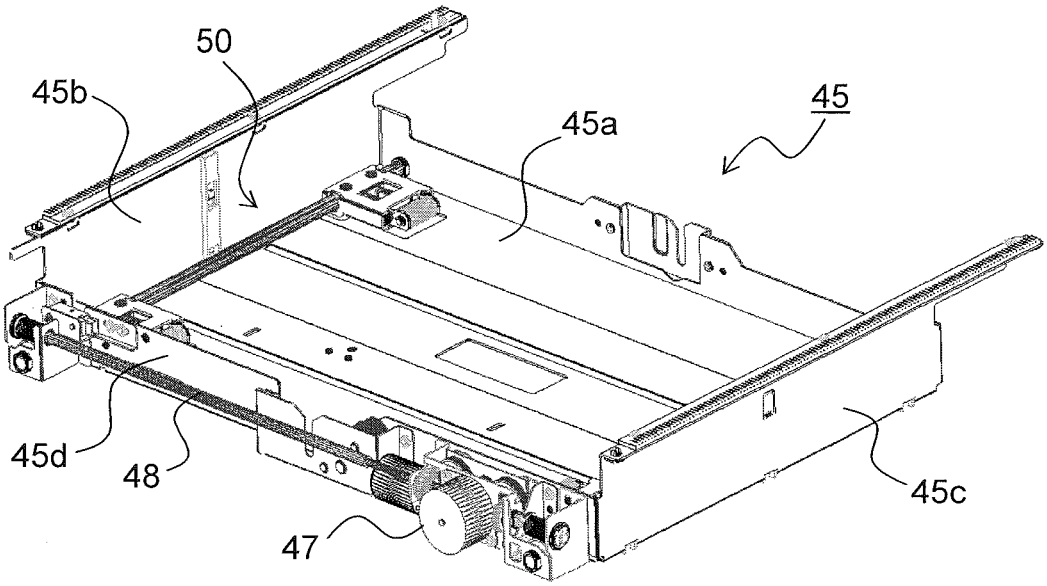
FIG. 10 is a view showing a state in which the wiping mechanism is removed from a unit housing of the maintenance unit.
Figure 11:
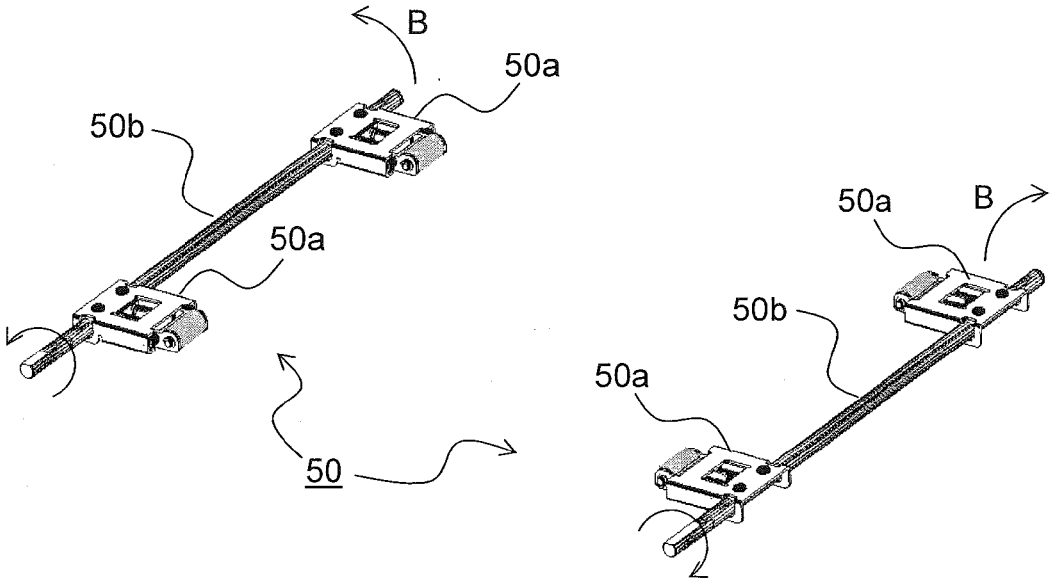
FIG. 11 is a view of a step-up/down mechanism disposed in the unit housing, that is, a view showing a state in which a lift member is in a horizontal state.

Next, a step-up/down mechanism 50 for stepping-up/down the wiping mechanism 30 of the present embodiment is described. The maintenance unit 19 includes a unit housing 45 shown in FIG. 10, the wiping mechanism 30 (see FIG. 6) disposed in the unit housing 45, and the step-up/down mechanism 50 disposed in the unit housing 45. As shown in FIG. 10 and FIG. 11, on a bottom surface 45*a* of the unit housing 45, the step-up/down mechanisms 50, in which two lift members 50*a* are fixed to both ends of a shaft 50*b*, are disposed in pairs along opposing side surfaces 45*b*, 45*c* in the movement direction (arrow AA' direction of FIG. 6) of the carriage 31. In other words, the step-up/down mechanisms 50 are disposed at positions opposing both ends (both upper and lower end portions of FIG. 2) of the recording portion 9 in the width direction of the head housing 10. In the meantime, in FIG. 10, the step-up/down mechanism 50 near the side surface 45*c* is not shown. Besides, a side surface 45*d* of the unit housing 45 abutting the side surfaces 45*b*, 45*c* is provided with a motor 47, and a drive transmission shaft 48 that transmits rotation force of the motor 47 to the shaft 50*b*.

Figure 13:
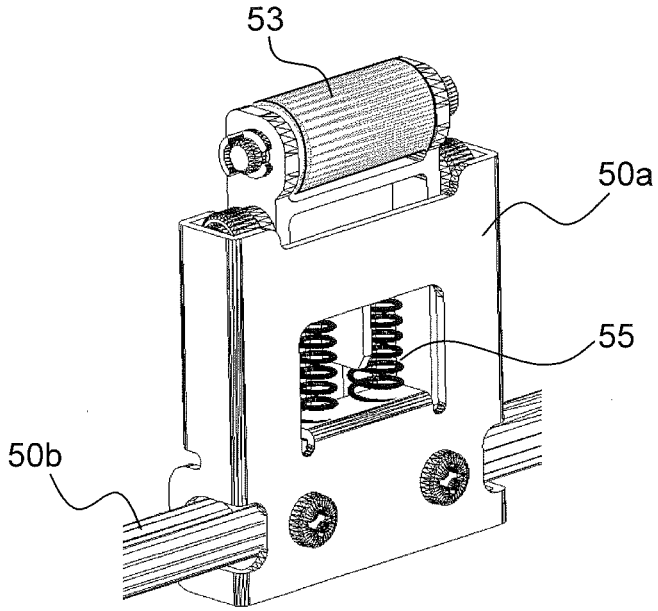
FIG. 13 is a view of the lift member that composes the step-up/down mechanism.

As shown in FIG. 13, a lower end portion of the lift member 50*a* is fixed to the shaft 50*b*, and the lift member 50*a* pivots in accordance with rotation of the shaft 50*b*. A push-up roller 53 is rotatably disposed on an upper end portion of the lift member 50*a*. The push-up roller 53 is biased by a coil spring 55 in a direction (upward direction of FIG. 13) leaving the shaft 50*b*.

When the shaft 50*b* of the right step-up/down mechanism 50 is rotated from a state of FIG. 11 in a clockwise direction and the shaft 50*b* of the left step-up/down mechanism 50 is rotated in a counterclockwise direction, the lift member 50*a* fallen inside the unit housing 45 rises in an outward direction (arrow B direction), whereby the lift member 50*a* is switched from a horizontal state to an upright state (state of FIG. 12) to step up the carriage 31 together with the support frame 40.

Figure 12:
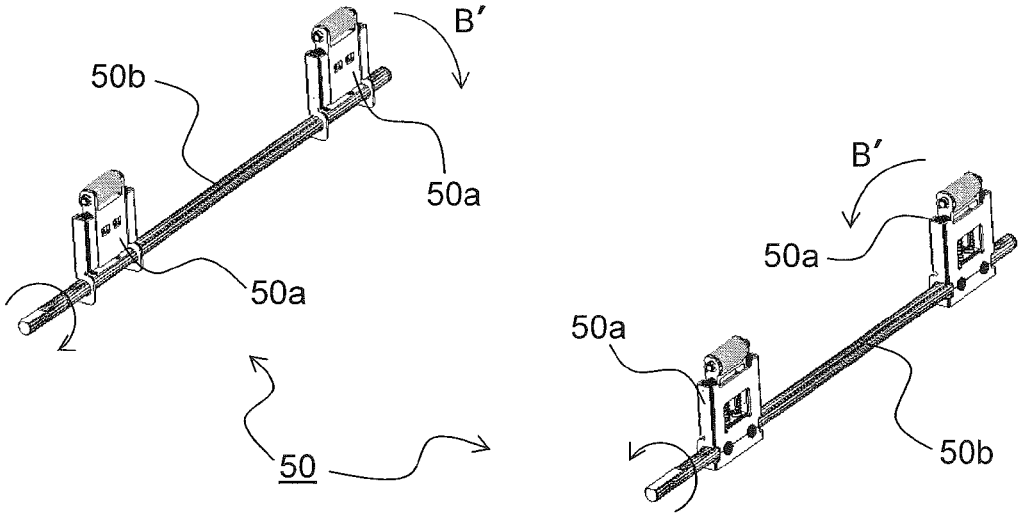
FIG. 12 is a view of the step-up/down mechanism disposed in the unit housing, that is, a view showing a state in which the lift member moves upright from the state in FIG. 11.

On the other hand, when the shaft 50*b* of the right step-up/down mechanism 50 is rotated from a state of FIG. 12 in the counterclockwise direction and the shaft 50*b* of the left step-up/down mechanism 50 is rotated in the clockwise direction, the lift member 50*a* falls in an inward direction (arrow B' direction) of the unit housing 45, whereby the lift member 50*a* is switched from the upright state to the horizontal state (state of FIG. 11) to step down the carriage 31 together with the support frame 40.

Next, a recovery operation of the recording heads 17*a* to 17*c* by means of the wiping mechanism 30 of the ink-jet recording apparatus 100 according to the present embodiment is described. In the meantime, FIG. 15, FIG. 16, and FIG. 27 each show a state in which the recording portion 9 and the maintenance unit 19 are seen from a downstream side (left of FIG. 14) in the sheet conveyance direction. Besides, the support frame 40 is illustrated like a plate in a simplified manner, and as to the unit housing 45, only the bottom surface 45*a* is illustrated. Besides, the recovery operation of the recording heads 17*a* to 17*c* and the cap unit mounting operation described later are executed by controlling operations of the recording heads 17*a* to 17*c*, wiping mechanism 30, step-up/down mechanism 50 and the like based on control signals from the control portion 110 (see FIG. 1).

Figure 14:
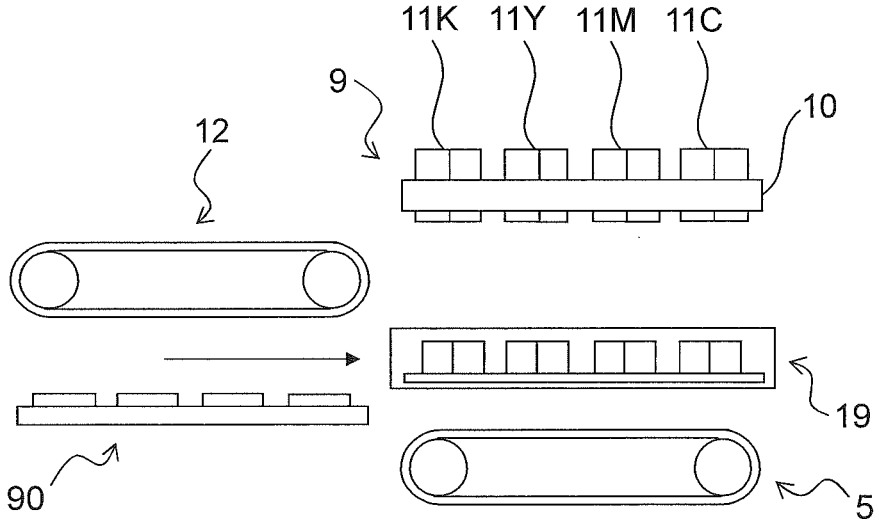
FIG. 14 is a view showing a state in which the maintenance unit is positioned under the recording portion.
Figure 15:
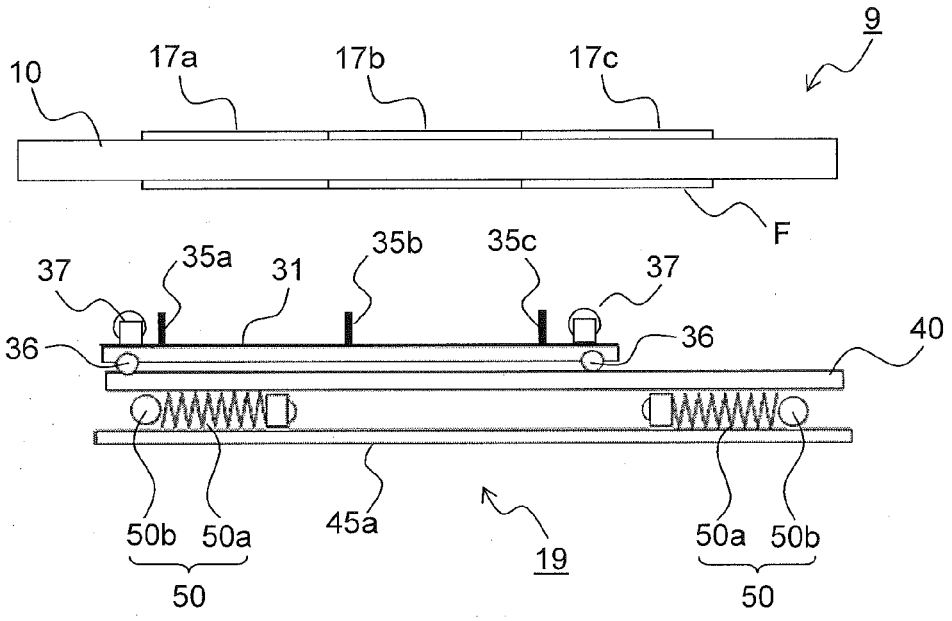
FIG. 15 is a view showing a carriage, the wiper, a support frame, and the step-up/down mechanism in the maintenance unit in the state of FIG. 14.

In a case where the recovery operation of the recording heads 17*a* to 17*c* is performed, first, as shown in FIG. 14, the first conveyance unit 5 located under the recording portion 9 is stepped down. And, the maintenance unit 19 disposed under the second conveyance unit 12 is moved horizontally to be positioned between the recording portion 9 and the first conveyance unit 5. In this state, as shown in FIG. 15, the lift member 50*a* of the step-up/down mechanism 50 is in the horizontal state, and the wipers 35*a* to 35*c* fixed to the carriage 31 are spaced away from the ink ejecting surface F of the recording heads 17*a* to 17*c*.

(Ink Pushing-Out Operation)

Figure 17:
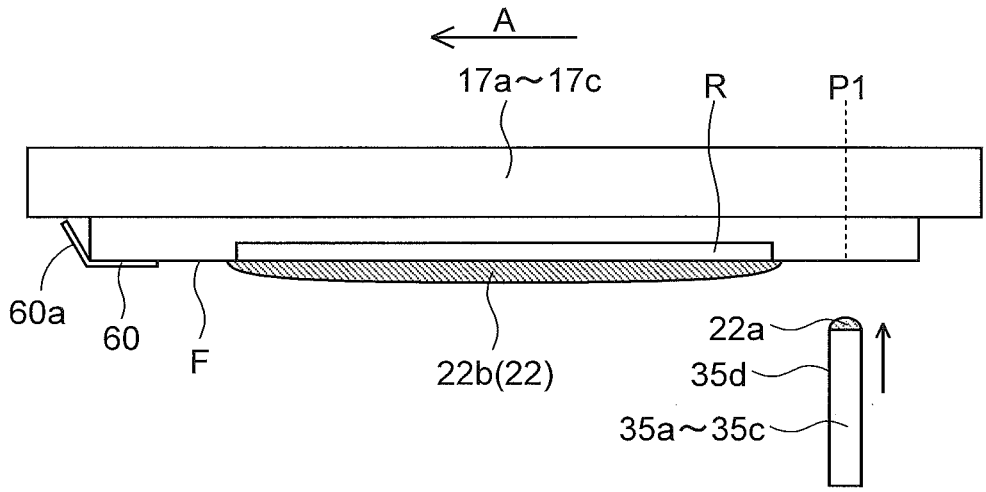
FIG. 17 is a view of the recording head showing a state in which the wiper is positioned under a first position.
Figure 18:
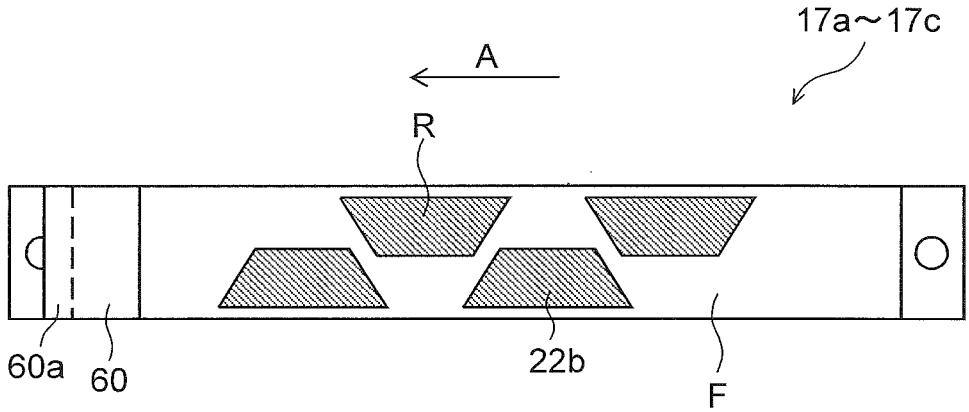
FIG. 18 is a view of the recording head seeing the ink ejecting surface in the state of FIG. 14 from under.

Previous to the wiping operation (first wiping operation described later), the ink 22 is supplied to the recording heads 17*a* to 17*c*. As shown in FIG. 17, the supplied ink 22 is forcibly pushed out (purged) from the ink ejecting nozzles 18. The thickened ink, foreign matter and air bubbles in the ink ejecting nozzles 18 are discharged by the purge operation, whereby it is possible to recover the recording heads 17*a* to 17*c*. During this time, as shown in FIG. 18, the purged ink 22*b* is pushed out onto the ink ejecting surface F along the shape of the nozzle region R where the ink ejecting nozzles 18 are present.

(First Wiping Operation)

Figure 16:
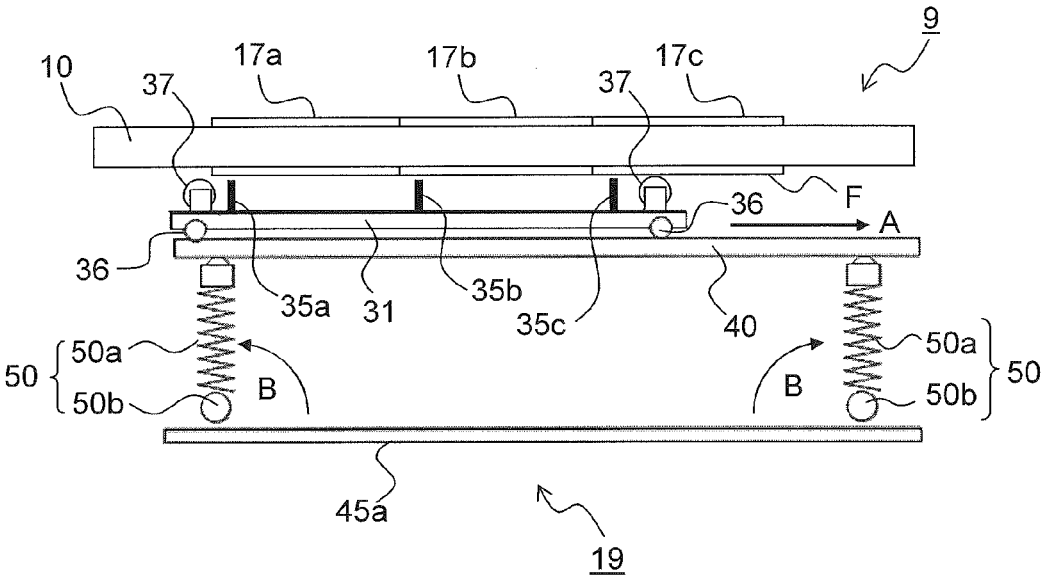
FIG. 16 is a view showing a state in which the support frame and the carriage are stepped up by the step-up/down mechanism from the state of FIG. 15 and the wiper is positioned to abut the ink ejecting surface.

The wipers 35*a* to 53*c* are made to contact a first position P1 of the ink ejecting surface F of the recording heads 17*a* to 17*c* outside the nozzle region R at a predetermined pressure. Specifically, as shown in FIG. 16 and FIG. 17, the shaft 50*b* of the step-up/down mechanism 50 is rotated to make the lift member 50*a* rise upright in the arrow B direction, whereby the support frame 40 and the carriage 31 are stepped up. At this time, gap rollers 37 disposed on the carriage 31 are pressed against a lower surface of the head housing 10 by the bias force of the coil spring 55 (see FIG. 13) of the lift member 50*a*. Accordingly, it is always possible to press the wipers 35*a* to 35*c* against the ink ejecting surface F at a constant pressure.

Figure 19:
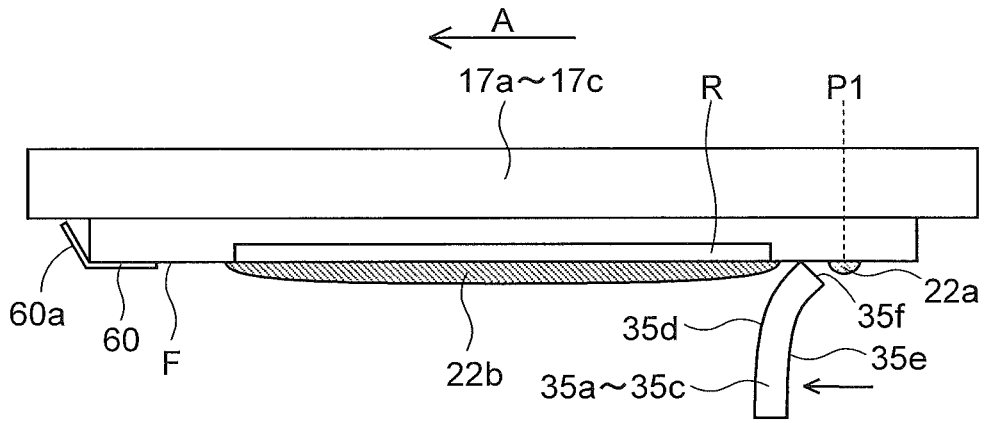
FIG. 19 is a view of the recording head showing a state in which the wiper is moved in an arrow A direction with the wiper pressed against the ink ejecting surface.

From the state in which tip ends of the wipers 35*a* to 35*c* are in tight contact with the ink ejecting surface F, the input gear 43 (see FIG. 6) is rotated forward to move the carriage 31 in the arrow A direction of FIG. 16, whereby also the wipers 35*a* to 35*c* supported by the carriage 31 move in the direction (left direction, first direction) to the nozzle region R along the ink ejecting surface F as shown in FIG. 19. An upward force acts on the support frame 40 by means of the step-up/down mechanism 50. Accordingly, the carriage 31 moves in the arrow A direction while keeping the state in which the gap rollers 37 are pressed against the head housing 10.

At this time, as shown in FIG. 19, the remaining ink 22*a*, which remains on the tip ends (upper ends) of the wipers 35*a* to 35*c* after the previous recovery operation of the recording heads and is exposed to air for a long time to be thickened, adheres to the first position P1 of the ink ejecting surface F and leaves the tip ends of the wipers 35*a* to 35*c*.

Figure 20:
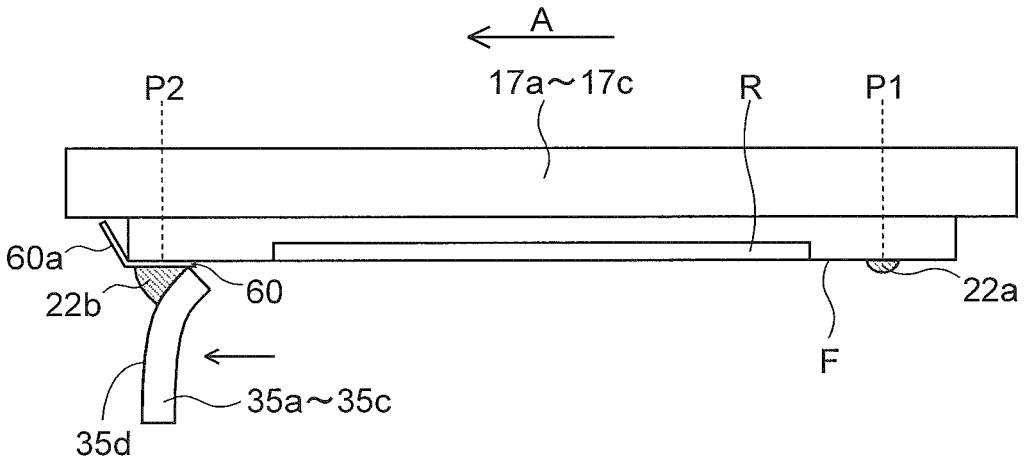
FIG. 20 is a view of the recording head showing a state in which the wiper is moved from the state of FIG. 19 to a second position.

And, as shown in FIG. 20, the wipers 35*a* to 35*c* moves in the left direction (arrow A direction) wiping away the purged ink 22*b* on the ink ejecting surface F while keeping the state of being in contact with the ink ejecting surface F, and on arriving at a position (second position P2 where the hydrophilic member 60 is disposed) opposite to the first position P1 with respect to the nozzle region R, the movement in the left direction is stopped. The water repellent treatment is applied to the first wiping surface 35*d* of the wipers 35*a* to 35*c*. Accordingly, although the purged ink 22*b* flows down along the first wiping surface 35*d*, it is possible to alleviate the ink 22*b* adhering to the first wiping surface 35*d*. In the meantime, the wasted ink flowing down the wipers 35*a* to 35*c* is collected by an ink collection tray (not shown).

(Leaving Operation)

Figure 21:
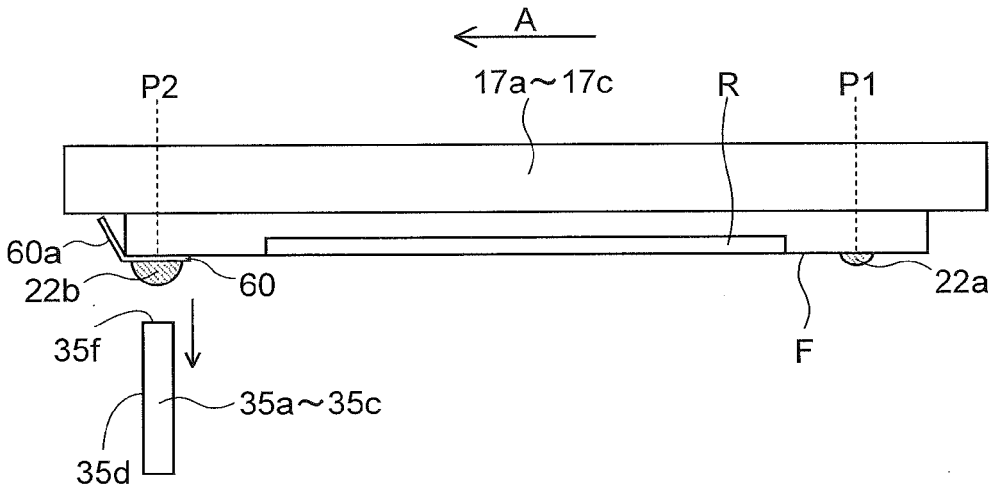
FIG. 21 is a view of the recording head showing a state in which the wiper is made to leave the ink ejecting surface at the second position.

After the execution of the first wiping operation, as shown in FIG. 21, the wipers 35*a* to 35*c* are made to leave the ink ejecting surface F. Specifically, by rotating backward the shaft 50*b* (see FIG. 16) of the step-up/down mechanism 50, the lift member 50*a* is pivoted in the arrow B' direction shown in FIG. 12 and brought to the horizontal state, whereby the support frame 40 and the carriage 31 are stepped down. In the meantime, the water repellent treatment is applied to the first wiping surface 35*d* and upper surface 35*f* of the wipers 35*a* to 35*c*. Accordingly, when making the wipers 35*a* to 35*c* leave the ink ejecting surface F, it is possible to alleviate the purged ink 22*b* adhering to the first wiping surface 35*d* and upper surface 35*f* of the wipers 35*a* to 35*c* and to increase the amount of the purged ink 22*b* adhering to the ink ejecting surface F.

(Moving Operation)

Figure 22:
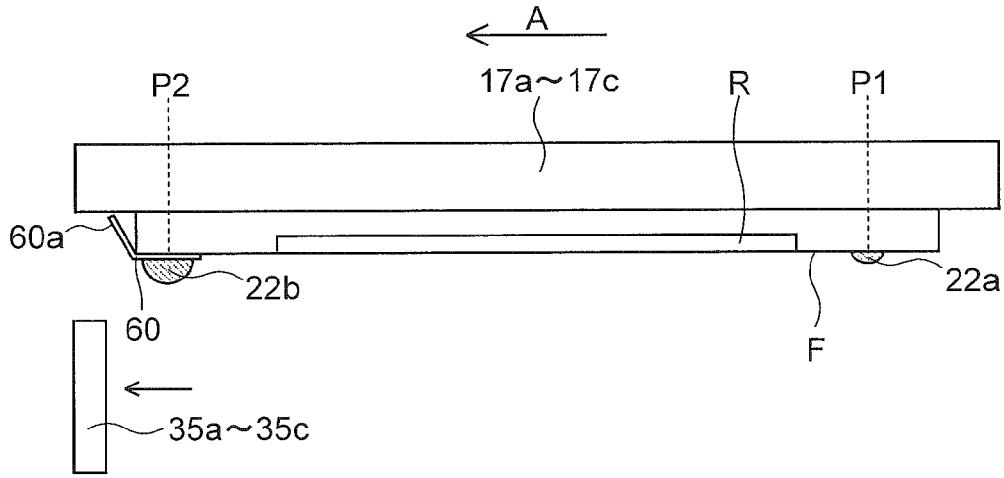
FIG. 22 is a view of the recording head showing a state in which the wiper is further moved in the arrow A direction from the state of FIG. 21.

After the execution of the leaving operation, as shown in FIG. 22, the wipers 35*a* to 35*c* are moved horizontally. Specifically, the input gear 43 (see FIG. 6) is rotated forward from the state of FIG. 21 to move the carriage 31 in the arrow A direction, whereby as shown in FIG. 22, the wipers 35*a* to 35*c* supported by the carriage 31 move in a direction (left direction) opposite to the nozzle region R with respect to the second position P2.

(Second Wiping Operation)

Figure 23:
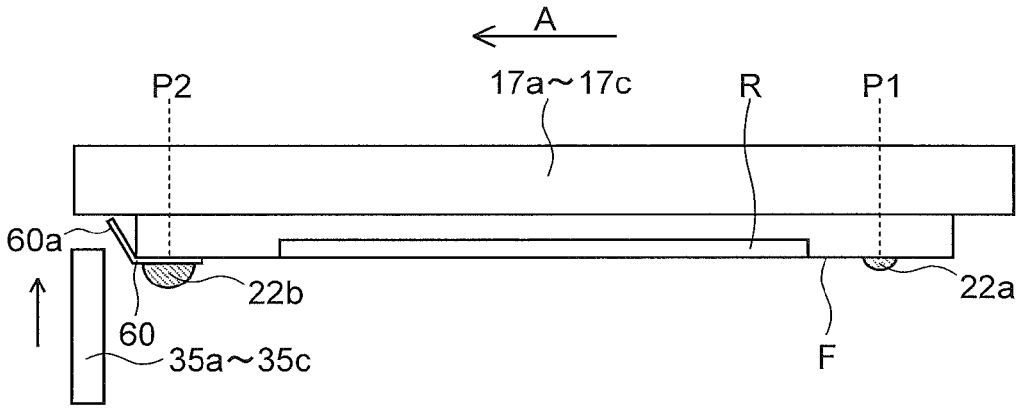
FIG. 23 is a view of the recording head showing a state in which the wiper is stepped up from the state of FIG. 22.
Figure 24:
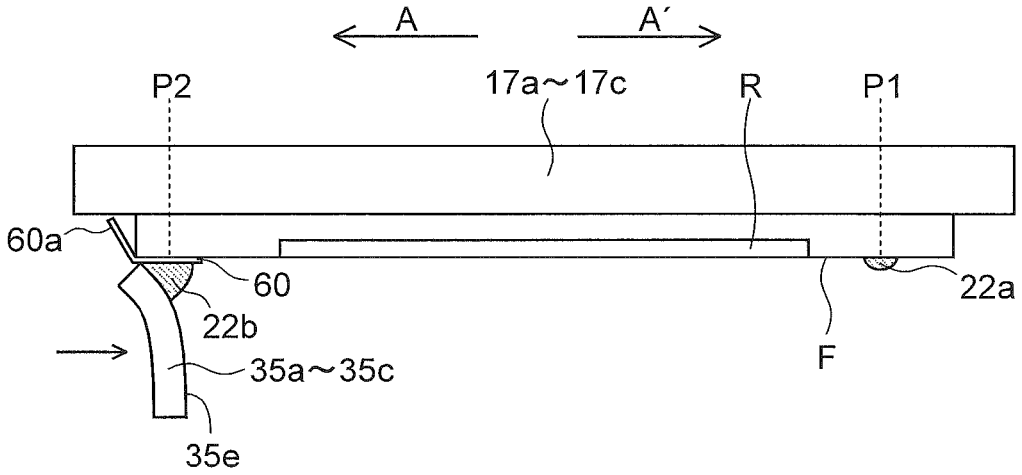
FIG. 24 is a view of the recording head showing a state in which the wiper is moved in an arrow A' direction from the state of FIG. 23.

Thereafter, a wiping operation (second wiping operation) is performed for wiping away the purged ink 22*b* and remaining ink 22*a* on the ink ejecting surface F. Specifically, the shaft 50*b* of the step-up/down mechanism 50 is rotated in the B direction to make the lift member 50*a* rise upright, whereby the support frame 40 and the carriage 31 are steppe up. In this way, as shown in FIG. 23, the wipers 35*a* to 35*c* are stepped up to a height to be able to contact the ink ejecting surface F. And, the input gear 43 (see FIG. 6) is rotated backward from the state of FIG. 23 to move the carriage 31 in s direction (right direction, second direction) opposite to the arrow A direction, whereby as shown in FIG. 24, the wipers 35*a* to 35*c* move in a direction (right direction) to the nozzle region R along the ink ejecting surface F while keeping the state of being in contact with the ink ejecting surface F. At this time, even if only a little amount of the ink 22 adheres to the tip ends of the wipers 35*a* to 35*c* after the leaving operation, the ink 22 is wiped away by the inclined surface 60*a* of the hydrophilic member 60. In the meantime, even in a case where the ink 22 collects on the inclined surface 60*a* of the hydrophilic member 60, unlike the case where the ink 22 collects on the ink ejecting surface F, it is possible to alleviate the collecting ink 22 contacting and staining a sheet surface.

Figure 25:
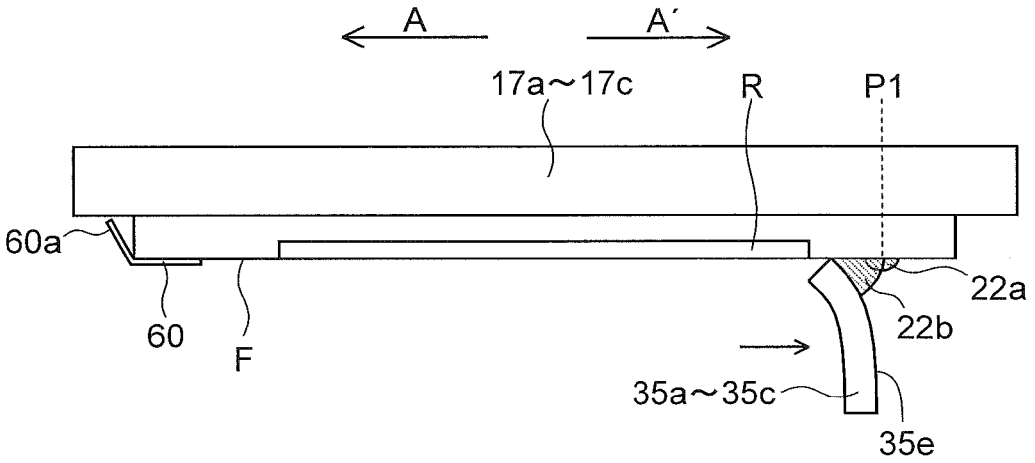
FIG. 25 is a view of the recording head showing a state in which the wiper is further moved in the arrow A' direction from the state of FIG. 24 and the purged ink contacts remaining ink.

And, the purged ink 22*b* on the second position P2 and the remaining ink 22*a* on the first position P1 are wiped away. At this time, as shown in FIG. 25, when the purged ink 22*b* wiped away by the wipers 35*a* to 35*c* contacts the remaining ink 22*a*, the remaining ink 22*a* merges into the purged ink 22*b* and the viscosity of the remaining ink 22*a* becomes low.

Figure 26:
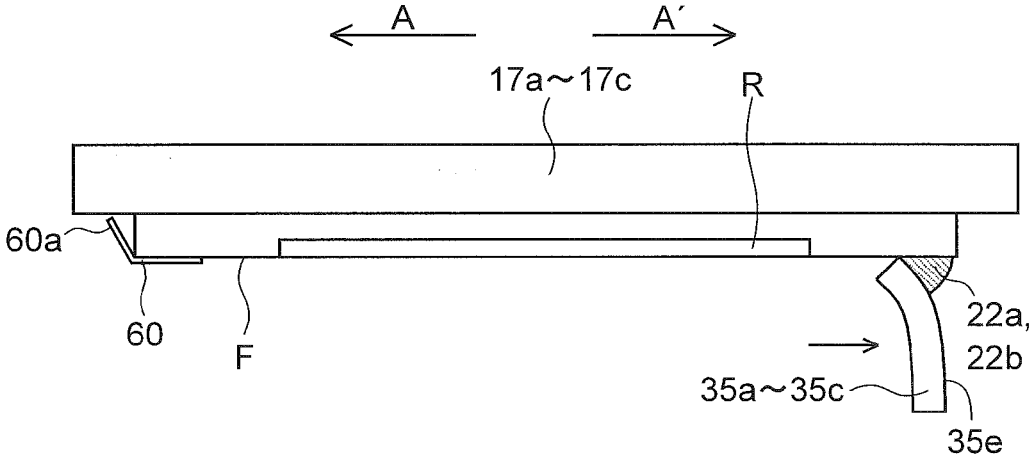
FIG. 26 is a view of the recording head showing a state in which the wiper is moved from the state of FIG. 25 to an end edge of the recording head on a downstream side in the arrow A' direction.
Figure 27:
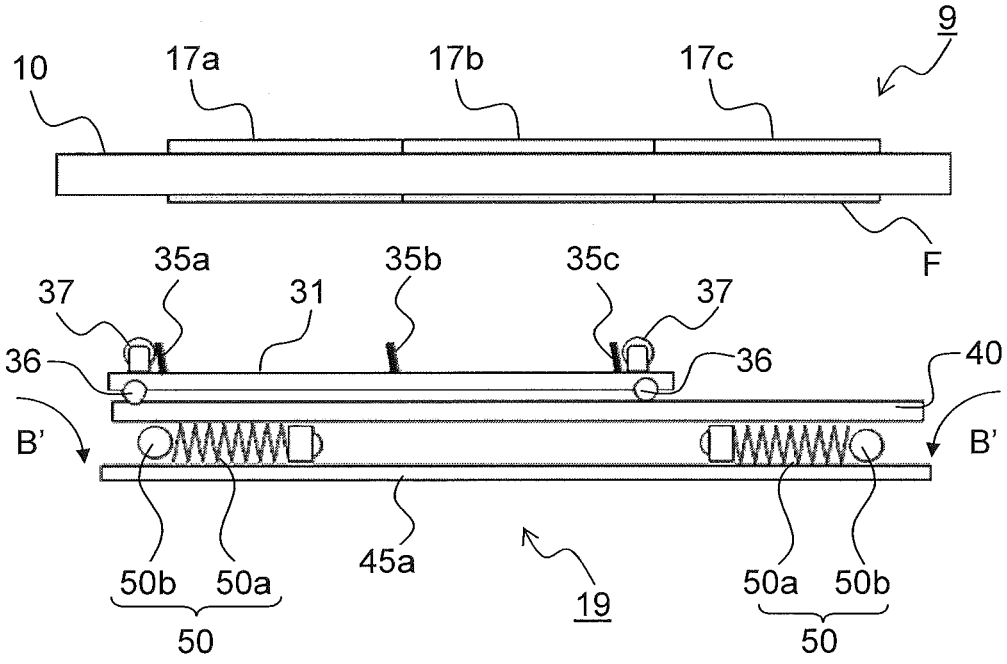
FIG. 27 is a view showing a state in which the support frame and the carriage are stepped down by the step-up/down mechanism and the wiper leaves the ink ejecting surface.
Figure 28A:
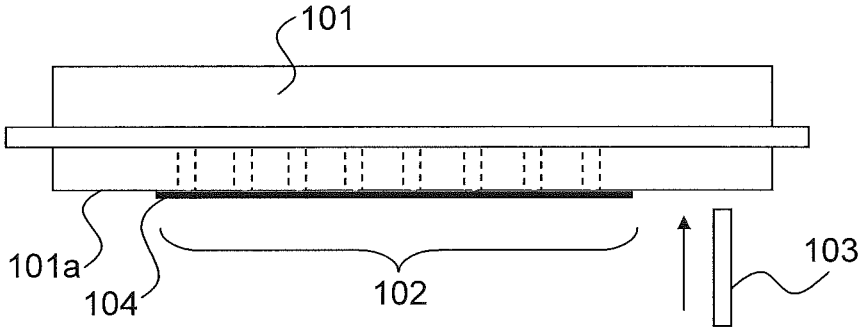
FIG.28A PRIOR ART
FIG. 28A is a view showing a conventional wiping mechanism that makes a wiper contact an ink ejecting surface at a predetermined contact pressure from a substantially perpendicular direction and cleans the ink ejecting surface of a recording head, that is, a view showing a state in which the wiper is positioned under a wiping start position.
Figure 28B:
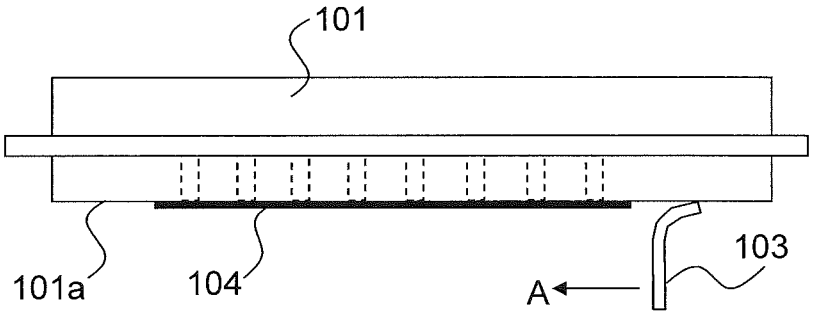
FIG.28B PRIOR ART
FIG. 28B is a view of the recording head showing a state in which the wiper is moved from the state of FIG. 28A to a nozzle region while making the wiper contact the ink ejecting surface.
Figure 28C:
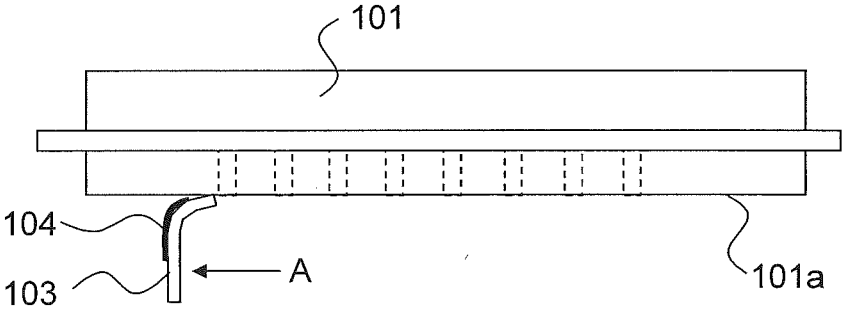
FIG.28C PRIOR ART
FIG. 28C is a view of the recording head showing a state in which the wiper is further moved from the state of FIG. 28B to pass through the nozzle region.
Figure 28D:
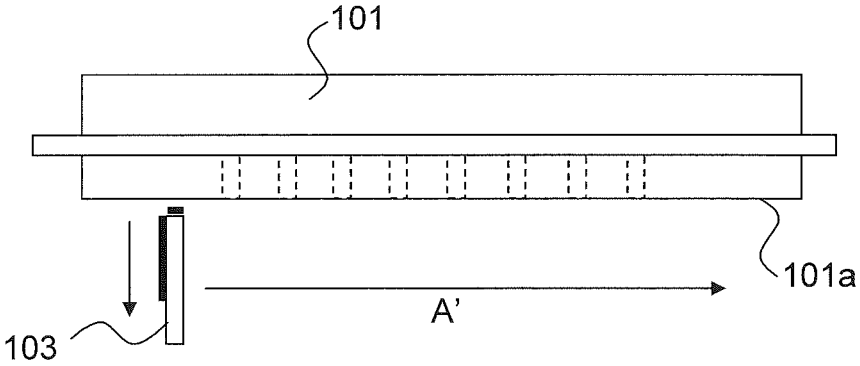
FIG.28D PRIOR ART
FIG. 28D is a view of the recording head showing a state in which the wiper is made to leave the ink ejecting surface from the state of FIG. 28C.
Figure 29A:
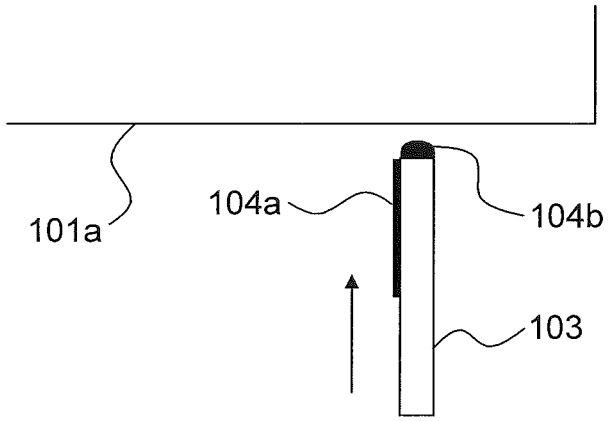
FIG.29A PRIOR ART
FIG. 29A is a view of the recording head showing a state in which the wiper is positioned under the wiping start position to perform the second wiping by using the conventional wiping mechanism shown in FIG. 28A.
Figure 29B:
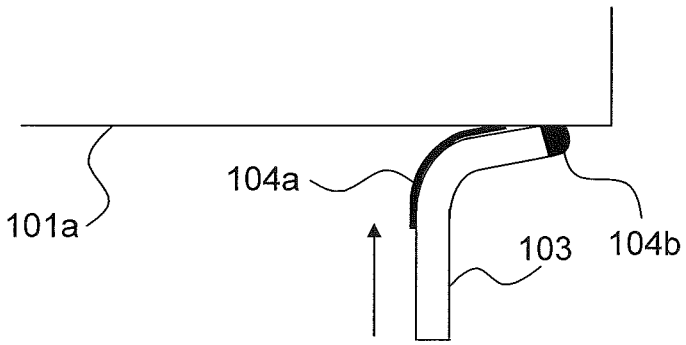
FIG.29B PRIOR ART
FIG. 29B is a view of the recording head showing a state in which the wiper is made to contact the ink ejecting surface from the state of FIG. 29A.
Figure 29C:
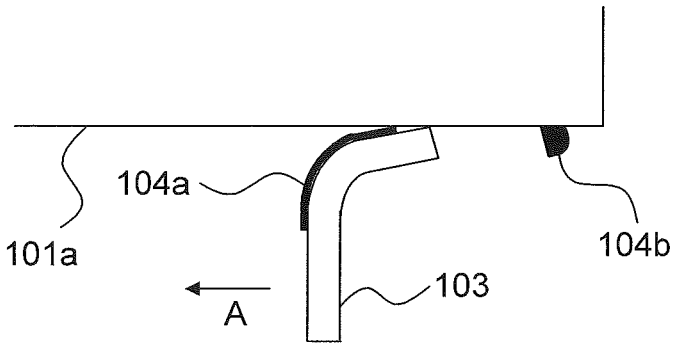
FIG.29C PRIOR ART
FIG. 29C is a view of the recording head showing a state in which the wiper is moved from the state of FIG. 29B toward the nozzle region while making the wiper contact the ink ejecting surface.

Thereafter, the wipers 35*a* to 35*c* move to an end edge (right end edge in FIG. 26) of the ink ejecting surface F of the recording heads 17*a* to 17*c* while keeping the state of being in contact with the ink ejecting surface F, and the wasted ink wiped away by the second wiping surfaces 35*e* of the wipers 35*a* to 35*c* flows down to be collected by an ink collection tray (not shown). And, as shown in FIG. 27, the shaft 50*b* of the step-up/down mechanism 50 is rotated to make the lift member 50*a* fall in the arrow B' direction, whereby the wipers 35*a* to 35*c* are evacuated downward from the ink ejecting surface F of the recording heads 17*a* to 17*c* to return the maintenance unit 19 to the state of FIG. 15. Lastly, the maintenance unit 19 positioned between the recording portion 9 and the first conveyance unit 5 is moved horizontally to be positioned under the second conveyance unit 12, and the first conveyance unit 5 is stepped up to a predetermined position to end the recovery operation of the recording heads 17*a* to 17*c*.

In a case where the cap unit 90 is mounted onto the recording heads 17*a* to 17*c*, first, as shown in FIG. 14, the first belt conveyance portion 5 disposed to oppose a lower surface of the recoding portion 9 is stepped down. And, the cap unit 90 disposed under the second belt conveyance portion 12 is moved horizontally into between the recording portion 9 and the first belt conveyance portion 5 to be positioned at a position opposing the recording portion 9.

Next, the first belt conveyance portion 5 is stepped up, whereby the cap unit 90 is pushed up. And, at a time the cap unit 90 comes into tight contact with the recording heads 17*a* to 17*c*, the stepping-up of the first belt conveyance portion 5 is stopped to complete the mounting of the cap unit 90.

In the present embodiment, as described above, after the execution of the first wiping operation for making the remaining ink 22*a* on the tip ends of the wipers 35*a* to 35*c* adhere to the first position P1 and wiping away the purged ink 22*b*, the second wiping operation, in which the wipers 35*a* to 35*c* are moved in the arrow A' direction (right direction) along the ink ejecting surface F, is executed, whereby it is possible to wipe away the remaining ink 22*a* on the first position P1 by means of the wipers 35*a* to 35*c*. In this way, it is possible to alleviate the remaining ink 22*a* collecting on the ink ejecting surface F. Accordingly, it is possible to alleviate a large ink puddle forming. Besides, unlike the case of disposing the two wipers that successively contact the ink ejecting surface F (conventional ink-jet recording apparatus that has the above two wipers), it is possible to alleviate the number of the wipers 35*a* to 35*c* increasing. Accordingly, it is possible to alleviate a structure of the recovery system for the recording heads 17*a* to 17*c* becoming complicated.

Besides, in the second wiping operation, the wipers 35*a* to 35*c* are moved in the arrow A' direction (right direction), whereby the wipers 35*a* to 35*c* wipe away the remaining ink 22*a*, which is made to adhere to the first position P1, by means of the purged ink 22*b*. In this way, when the wipers 35*a* to 35*c* wiping away the remaining ink 22*a*, the not-thickened purged ink 22*b* contacts the remaining ink 22*a* that is exposed to air for a long time to become high in viscosity. Accordingly, the remaining ink 22*a* merges into the purged ink 22*b* and the viscosity of the remaining ink 22*a* becomes low. Because of this, in the second wiping operation, it is possible to make it easy for the wipers 35*a* to 35*c* to wipe away the remaining ink 22*a* that adheres to the ink ejecting surface F.

Besides, the first wiping surface 35*d* and upper surface 35*f* of the wipers 35*a* to 35*c* have the high water repellency compared with the second wiping surface 35*e*. Because of this, during the first wiping operation time, it is possible to alleviate the purged ink 22*b* flowing downward. Accordingly, the ink 22 spreads in the width direction of the wipers 35*a* to 35*c*. Because of this, during the first wiping operation time, it is possible to clean the ink ejecting surface F across the whole wiper width direction (direction perpendicular to the paper surface of FIG. 17), and during the leaving operation time, it is possible to make the ink 22 adhere evenly to the second position P2 in the wiper width direction.

Besides, the first wiping surface 35*d* and the upper surface 35*f* have the high water repellency compared with the second wiping surface 35*e*, whereby during the leaving operation time, it is possible to alleviate the ink 22 adhering to the wipers 35*a* to 35*c*. In this way, it is possible to increase the amount of the ink 22 that adheres to the second position P2. Accordingly, in the second wiping operation, it is possible to alleviate some amount of ink being not wiped away from the second position P2 in the arrow A' direction (right direction). In the meantime, in a case where there is a region that is short of the purged ink 22*b* at the second position P2, if the second wiping operation is executed, some amount of ink is not wiped away and left on the ink ejecting surface F in the region that is short of the purged ink 22*b*.

Besides, as described above, in the second wiping operation, the control portion 110 moves the wipers 35*a* to 35*c* in the arrow A' direction (right direction) along the ink ejecting surface F from the position opposite to the nozzle region R with respect to the second position P2 to which the purged ink 22*b* is made to adhere. In this way, the wipers 35*a* to 35*c* wipe away the purged ink 22*b* on the second position P2, thereafter, wipe away the remaining ink 22*a*. Accordingly, it is possible to make it easy for the wipers 35*a* to 35*c* to wipe away the remaining ink 22*a* that adheres to the ink ejecting surface F.

Besides, as described above, the water repellent treatment is applied to the first wiping surface 35*d* and the upper surface 35*f*. Because of this, it is possible to easily form the first wiping surface 35*d* and the upper surface 35*f* of the wipers 35*a* to 35*c* in such a way that the first wiping surface 35*d* and upper surface 35*f* have the high water repellency compared with the second wiping surface 35*e*.

Besides, as described above, the hydrophilic treatment is applied to the second wiping surface 35*e*. Because of this, it is possible to make the purged ink 22*b* easily flow downward during the second wiping operation time. Accordingly, it is possible to alleviate an ink puddle forming on the wipers 35*a* to 35*c* by repeating the recovery operation.

Besides, as described above, the second wiping surface 35*e* is provided with the plurality of grooves 35*g* that extend in the vertical direction. Because of this, it is possible to easily raise the hydrophilicity of the second wiping surface 35*e*.

Besides, as described above, the first wiping surface 35*d* and the upper surface 35*f* have the high water repellency compared with the second position P2. Because of this, during the leaving operation time, it is possible to increase the amount of the ink 22 that adheres to the second position P2.

Besides, as described above, the second position P2 is formed to have the high hydrophilicity compared with the nozzle region R. Because of this, during the leaving operation time, it is also possible to increase the amount of the ink 22 that adheres to the second position P2.

It should be considered that the embodiment disclosed this time is an example in all respects and is not limiting. The scope of the present disclosure is not indicated by the above description of the embodiment but by the claims, and all modifications within the scope of the claims and the meaning equivalent to the claims are covered.

For example, in the above embodiment, the ink pushing-out operation is executed before the first wiping operation, but if it is before the wipers 35*a* to 35*c* enter the nozzle region R, the ink pushing-out operation may be executed at the same time as the first wiping operation.

Besides, in the above embodiment, the example is described, in which to raise the water repellency of the first wiping surface 35*d* and upper surface 35*f* of the wipers 35*a* to 35*c*, the water repellent material is applied to the first wiping surface 35*d* and the upper surface 35*f* by using the dip method, but the present disclosure is not limited to this. The method for applying the water repellent material is not especially limited, and for example, it is possible to perform the application by means of a spray coating method or other methods.

Besides, in the above embodiment, the example is described, in which to raise the hydrophilicity of the second wiping surface 35*e* of the wipers 35*a* to 35*c*, the plurality of grooves 35*g* extending in the vertical direction are formed by cutting, but the present disclosure is not limited to this.

For example, the plurality of grooves 35*g* may be formed by using a metal mold. Besides, by applying another hydrophilic treatment other than the plurality of grooves 35*g* extending in the vertical direction, the hydrophilicity of the second wiping surface 35*e* may be raised. Besides, by applying hydrophilic coating, the hydrophilicity of the second wiping surface 35*e* may be raised. Besides, the hydrophilic treatment may not be applied to the second wiping surface 35*e*.

Besides, as to the drive mechanism (rack teeth 38, input gear 43) and the step-up/down mechanism 50, it is possible to use another conventionally known drive mechanism and step-up/down mechanism. It is also possible to suitably set the number of the ink ejecting nozzles 18 of the recording heads 17*a* to 17*c*, the nozzle interval and the like in accordance with the specifications of the ink-jet recording apparatus 100. Besides, the number of recording heads is not especially limited, and for example, it is also possible to dispose the recording head 17 one, two, four or more for each line head 11C to 11K.

What is claimed is:

1. A recovery system for a recording head that is provided with a nozzle region from which an ejecting nozzle for ejecting ink onto a recording medium is opened, comprising:

a wiper that wipes away purged ink which is forcibly pushed out from the ejecting nozzle, a drive mechanism that reciprocates the wiper along an ink ejecting surface including the nozzle region, and a control portion that controls pushing-out, ejection of the ink from the ejecting nozzle and operation of the drive mechanism, wherein the control portion is able to execute a recording head recovery operation that includes: an ink pushing-out operation that forcibly pushes out the ink from the ejecting nozzle and makes the purged ink adhere to the nozzle region; a first wiping operation that presses the wiper against a first position outside the nozzle region of the ink ejecting surface, thereafter, moves the wiper to the nozzle region in a first direction along the ink ejecting surface with the wiper pressed against the ink ejecting surface, thereby makes ink remaining on a tip end of the wiper adhere to the first position, wipes away the purged ink, and moves the wiper to a second position opposite to the first position with respect to the nozzle region; a leaving operation that after execution of the first wiping operation, makes the wiper leave the ink ejecting surface; and a second wiping operation that after execution of the leaving operation, presses the wiper against the ink ejecting surface, moves the wiper in a second direction opposite to the first direction along the ink ejecting surface with the wiper pressed against the ink ejecting surface and thereby wipes away the remaining ink, the wiper includes: a first wiping surface disposed to face in the first direction; a second wiping surface disposed to face in the second direction; and an upper surface disposed between the first wiping surface and the second wiping surface, the first wiping surface and the upper surface have a high water repellency compared with the second wiping surface, the control portion, in the leaving operation, makes the wiper leave the ink ejecting surface and thereby makes the ink adhere to the second position, and the control portion, in the second wiping operation, moves the wiper, from a position opposite to the nozzle region with respect to the second position, in the second direction along the ink ejecting surface and thereby wipes away the ink on the second position and the remaining ink.

2. The recovery system for the recording head according to claim 1, wherein a water repellent treatment is applied to the first wiping surface and the upper surface.

3. The recovery system for the recording head according to claim 1, wherein a hydrophilic treatment is applied to the second wiping surface.

4. The recovery system for the recording head according to claim 3, wherein the second wiping surface is provided with a plurality of grooves that extend in a vertical direction.

5. The recovery system for the recording head according to claim 1, wherein the first wiping surface and the upper surface have a high water repellency compared with the second position.

6. The recovery system for the recording head according to claim 1, wherein the second position is formed to have a high hydrophilicity compared with the nozzle region.

7. The recovery system for the recording head according to claim 6, wherein a predetermined region of the ink ejecting surface including the second position is provided with a hydrophilic member that has a high hydrophilicity compared with the nozzle region.

8. An ink-jet recording apparatus comprising the recovery system for the recording head according to claim 1.

9. A recovery system for a recording head that is provided with a nozzle region from which an ejecting nozzle for ejecting ink onto a recording medium is opened, comprising:

a wiper that wipes away purged ink which is forcibly pushed out from the ejecting nozzle;

a drive mechanism that reciprocates the wiper along an ink ejecting surface including the nozzle region; and a control portion that controls pushing-out, ejection of the ink from the ejecting nozzle and operation of the drive mechanism, wherein the control portion is able to execute a recording head recovery operation that includes: an ink pushing-out operation that forcibly pushes out the ink from the ejecting nozzle and makes the purged ink adhere to the nozzle region; a first wiping operation that presses the wiper against a first position outside the nozzle region of the ink ejecting surface, thereafter, moves the wiper to the nozzle region in a first direction along the ink ejecting surface with the wiper pressed against the ink ejecting surface, thereby makes ink remaining on a tip end of the wiper adhere to the first position, wipes away the purged ink, and moves the wiper to a second position opposite to the first position with respect to the nozzle region; a leaving operation that after execution of the first wiping operation, makes the wiper leave the ink ejecting surface; and a second wiping operation that after execution of the leaving operation, presses the wiper against the ink ejecting surface, moves the wiper in a second direction opposite to the first direction along the ink ejecting surface with the wiper pressed against the ink ejecting surface and thereby wipes away the remaining ink, the wiper includes: a first wiping surface disposed to face in the first direction; a second wiping surface disposed to face in the second direction; and an upper surface disposed between the first wiping surface and the second wiping surface, the first wiping surface and the upper surface have a high water repellency compared with the second wiping surface, and the first wiping surface and the upper surface have a high water repellency compared with the second position.

10. The recovery system for the recording head according to claim 9, wherein a water repellent treatment is applied to the first wiping surface and the upper surface.

11. The recovery system for the recording head according to claim 9, wherein a hydrophilic treatment is applied to the second wiping surface.

12. The recovery system for the recording head according to claim 11, wherein the second wiping surface is provided with a plurality of grooves that extend in a vertical direction.

13. The recovery system for the recording head according to claim 9, wherein the second position is formed to have a high hydrophilicity compared with the nozzle region.

14. The recovery system for the recording head according to claim 13, wherein a predetermined region of the ink ejecting surface including the second position is provided with a hydrophilic member that has a high hydrophilicity compared with the nozzle region.

15. An ink-jet recording apparatus comprising the recovery system for the recording head according to claim 9.

16. A recovery system for a recording head that is provided with a nozzle region from which an ejecting nozzle for ejecting ink onto a recording medium is opened, comprising:

a wiper that wipes away purged ink which is forcibly pushed out from the ejecting nozzle;

a drive mechanism that reciprocates the wiper along an ink ejecting surface including the nozzle region; and a control portion that controls pushing-out, ejection of the ink from the ejecting nozzle and operation of the drive mechanism, wherein the control portion is able to execute a recording head recovery operation that includes: an ink pushing-out operation that forcibly pushes out the ink from the ejecting nozzle and makes the purged ink adhere to the nozzle region; a first wiping operation that presses the wiper against a first position outside the nozzle region of the ink ejecting surface, thereafter, moves the wiper to the nozzle region in a first direction along the ink ejecting surface with the wiper pressed against the ink ejecting surface, thereby makes ink remaining on a tip end of the wiper adhere to the first position, wipes away the purged ink, and moves the wiper to a second position opposite to the first position with respect to the nozzle region; a leaving operation that after execution of the first wiping operation, makes the wiper leave the ink ejecting surface; and a second wiping operation that after execution of the leaving operation, presses the wiper against the ink ejecting surface, moves the wiper in a second direction opposite to the first direction along the ink ejecting surface with the wiper pressed against the ink ejecting surface and thereby wipes away the remaining ink, the wiper includes: a first wiping surface disposed to face in the first direction; a second wiping surface disposed to face in the second direction; and an upper surface disposed between the first wiping surface and the second wiping surface, the first wiping surface and the upper surface have a high water repellency compared with the second wiping surface, and the second position is formed to have a high hydrophilicity compared with the nozzle region.

17. The recovery system for the recording head according to claim 16, wherein a water repellent treatment is applied to the first wiping surface and the upper surface.

18. The recovery system for the recording head according to claim 16, wherein a hydrophilic treatment is applied to the second wiping surface.

19. The recovery system for the recording head according to claim 16, wherein a predetermined region of the ink ejecting surface including the second position is provided with a hydrophilic member that has a high hydrophilicity compared with the nozzle region.

20. An ink-jet recording apparatus comprising the recovery system for the recording head according to claim 16.

* * * * *